US009639046B2

(12) United States Patent
Fujikura

(10) Patent No.: US 9,639,046 B2
(45) Date of Patent: May 2, 2017

(54) IMAGE FORMING APPARATUS

(71) Applicant: Oki Data Corporation, Tokyo (JP)

(72) Inventor: Shuichi Fujikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/240,979

(22) Filed: Aug. 18, 2016

(65) Prior Publication Data

US 2017/0075276 A1 Mar. 16, 2017

(30) Foreign Application Priority Data

Sep. 10, 2015 (JP) ..... 2015-178113

(51) Int. Cl.
*G03G 15/00* (2006.01)
*G03G 15/16* (2006.01)

(52) U.S. Cl.
CPC ..... *G03G 15/5062* (2013.01); *G03G 15/1615* (2013.01)

(58) Field of Classification Search
CPC ..... G03G 15/1635
USPC ..... 399/389
See application file for complete search history.

(56) References Cited

U.S. PATENT DOCUMENTS 4,984,024 A * 1/1991 Ohkaji ..... G03G 15/1635 399/299
5,043,759 A * 8/1991 Sakai ..... G03G 15/228 355/27
9,139,024 B2 * 9/2015 Driggers ..... B41J 11/0095
2009/0059249 A1 * 3/2009 Izumiya ..... G03G 15/5062 358/1.9
2010/0157305 A1 * 6/2010 Henderson ..... G03G 15/5062 356/445
2010/0294154 A1 * 11/2010 Rapkin ..... G03G 15/5062 101/486
2013/0293625 A1 * 11/2013 Massen ..... B41J 2/125 347/19

FOREIGN PATENT DOCUMENTS

JP H08-262884 A 10/1996

* cited by examiner

*Primary Examiner* — Anthony Nguyen
(74) *Attorney, Agent, or Firm* — Rabin & Berdo, P.C.

(57) ABSTRACT

An image forming apparatus configured to form an image on a recording medium. The image forming apparatus includes an optical sensor disposed on a conveyance path of the recording medium. The optical sensor is configured to detect position information of the recording medium conveyed along the conveyance path. A sensor cover is disposed between the optical sensor and the recording medium whose position information is detected by the optical sensor. The sensor cover is configured to guide the recording medium. The sensor cover has a first side facing the optical sensor. The sensor cover includes an electrically conductive surface on the first side. The electrically conductive surface is electrically connected to a main body of the image forming apparatus.

14 Claims, 11 Drawing Sheets

IMAGE FORMING APPARATUS

BACKGROUND OF THE INVENTION

The present invention relates to image forming apparatuses such as a copier, a printer or the like, and particularly relates to an image forming apparatus including a static electricity remover disposed at a medium conveyance path.

In an image forming apparatus, when a conveyed recording medium may be electrically charged due to friction or the like, an unfavorable event may occur. Therefore, in a conventional configuration, a contact brush or a noncontact brush is provided for removing static electricity from the recording medium. Such a configuration is disclosed by, for example, Japanese Patent Application Publication No. H8-262884 (Page 4, FIG. 5).

In another conventional configuration, a medium conveyance path is formed of electrically conductive resin so as to prevent the recording medium from being electrically charged when the recording medium is conveyed along the conveyance path.

In this regard, there is a case where an optical sensor is disposed at the conveyance path for detecting an eye mark of a roll paper or an interval between continuous cut-form papers. The optical sensor detects reflected light or transmitted light via a sensor cover provided so as to guide the conveyed recording medium. When the sensor cover is electrically charged, discharge noise may intrude into an electrical system of the optical sensor, and malfunction of the optical sensor may occur. The conventional static electricity remover has an insufficient effect of removing static electricity, and cannot prevent electrical charging of the sensor cover. Further, if the conveyance path is formed of conductive resin, a sufficient function of the optical sensor cannot be obtained since the conductive resin has low or uneven transparency.

SUMMARY OF THE INVENTION

The present invention is intended to provide an image forming apparatus capable of preventing a sensor cover from being electrically charged.

According to an aspect of the present invention, there is provided an image forming apparatus configured to form an image on a recording medium. The image forming apparatus includes an optical sensor disposed on a conveyance path of the recording medium. The optical sensor is configured to detect position information of the recording medium conveyed along the conveyance path. A sensor cover is disposed between the optical sensor and the recording medium whose position information is detected by the optical sensor. The sensor cover is configured to guide the recording medium. The sensor cover has a first side facing the optical sensor. The sensor cover includes an electrically conductive surface on the first side. The electrically conductive surface is electrically connected to a main body of the image forming apparatus.

With such a configuration, the sensor cover is prevented from being electrically charged by contact with the recording medium. Therefore, it becomes possible to prevent intrusion of discharge noise into a detection signal of the optical sensor, and to prevent deterioration of detection accuracy by the discharge noise.

DETAILED DESCRIPTION OF THE PREFERRED EMBODIMENT

Embodiment 1

Figure 1:
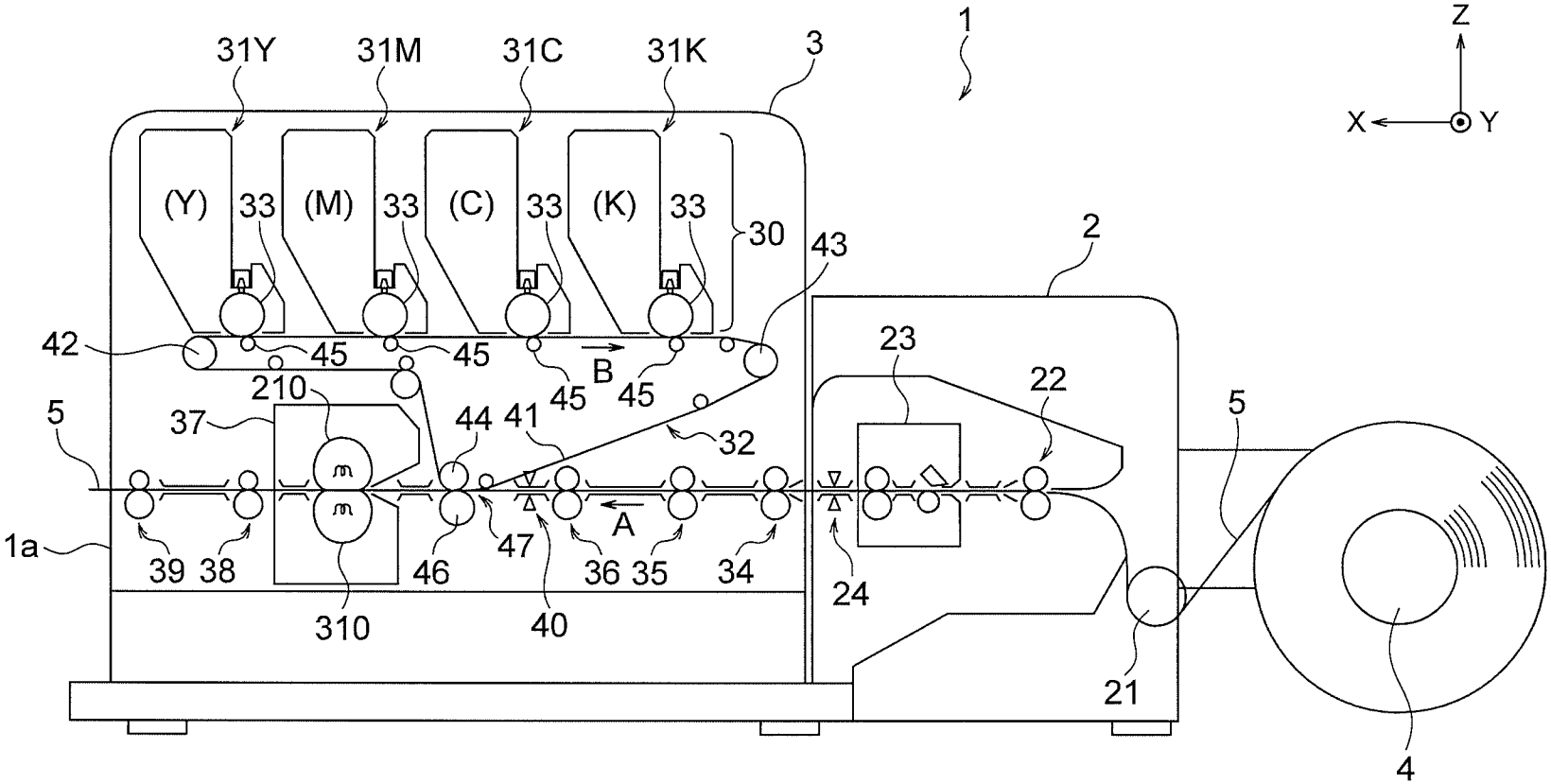
FIG. 1 is a view showing a configuration of a printer as an image forming apparatus according to Embodiment 1 of the present invention.

FIG. 1 is a view showing a configuration of a printer 1 as an image forming apparatus of Embodiment 1. The printer 1 is an electrophotographic color printer corresponding to a roll paper 5 (also referred to as a continuous printing sheet).

As shown in FIG. 1, the printer 1 includes a sheet holder (i.e., a medium holder) that holds the roll paper 5 as a recording medium, an introducing guide section 2 as an introducing section for the roll paper 5, and a printing section 3 that performs printing on the roll paper 5.

The sheet holder 4 is configured to rotatably hold, for example, the roll paper 5 at a core of the roll paper 5. The sheet holder 4 rotates following a movement of the roll paper 5 as a leading end side of the roll paper 5 is pulled by the introducing guide section 2. With such a configuration, the sheet holder 4 continuously supplies the roll paper 5 to the introducing guide section 2.

The introducing guide section 2 includes a guide roller 21 guiding the conveyed roll paper 5, and a feed roller pair (i.e., a pair of feed rollers) 22 disposed on a conveyance path for conveying the roll paper 5 downstream. The introducing guide section 2 further includes a sheet cutter 23 disposed downstream of the feed rollers 22 in a conveyance direction of the roll paper 5, and an optical sheet sensor 24 disposed downstream of the sheet cutter 23. The introducing guide section 2 conveys the roll paper 5 at predetermined timings, and cuts the roll paper 5 as necessary. The optical sheet sensor 24 detects presence/absence of the roll paper 5 to be conveyed to the printing section 3.

Figure 2B:
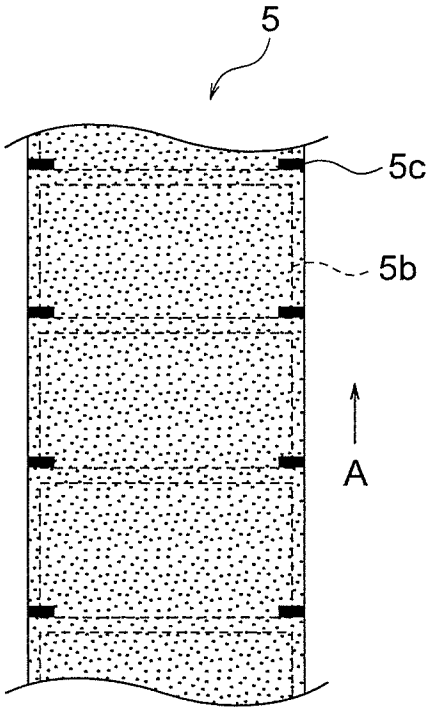
FIG. 2B is a view showing a back side of the roll paper as seen from below.
Figure 2A:
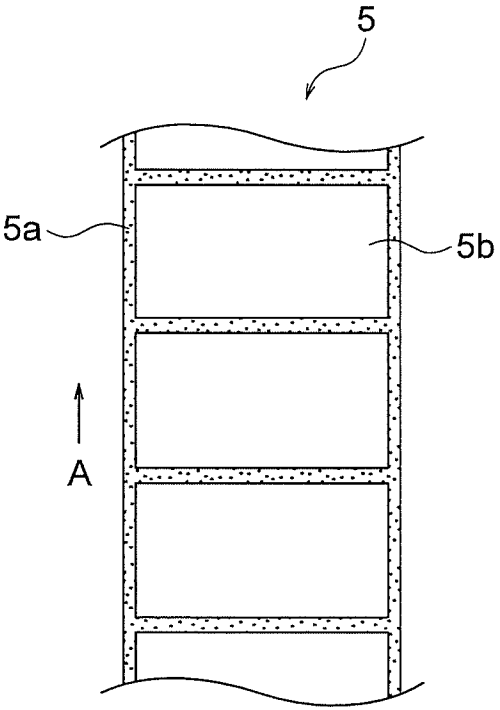
FIG. 2A is a view showing a surface side of a roll paper.

Here, description will be made of an example in which a label roll paper is used as the roll paper 5. FIGS. 2A and 2B respectively show a surface side (i.e., an upper side) and a back side (i.e., a lower side) of the roll paper 5. In FIGS. 2A and 2B, an arrow A indicates the conveyance direction of the roll paper 5. For example, as shown in FIG. 2B, the roll paper 5 (i.e., the label roll paper) includes an elongated base sheet 5*a* and labels 5*b* bonded to a surface of the base sheet 5*a* at equal intervals. Further, as shown in FIG. 2A, eye marks 5*c* are formed on a back surface of the base sheet 5*a* at equal intervals. The eye marks 5*c* are disposed at positions corresponding to the labels 5*b*.

Three conveyance roller pairs (i.e., three pairs of conveyance rollers) 34, 35 and 36 and an optical sheet sensor 40 are disposed along a conveyance path in the printing section 3. The conveyance roller pairs 34, 35 and 36 and the optical sheet sensor 40 are arranged in this order from upstream in the conveyance direction shown by the arrow A. The conveyance roller pairs 34, 35 and 36 are configured to convey the roll paper 5 to a secondary transfer portion 47 as a transfer portion. The optical sheet sensor 40 is configured to detect the eye mark 5*c* (FIG. 2B) for determining a timing to start writing (exposure) in the printing section 3.

The printing section 3 includes an image forming section 30 including four process units 31Y, 31M, 31C and 31K that respectively form toner images (i.e., developer images) of yellow (Y), magenta (M), cyan (C) and black (K). The process units 31Y, 31M, 31C and 31K will be referred simply to as the process units 31 when need not be distinguished from one another. The process units 31Y, 31M, 31C and 31K are arranged in this order from upstream in a moving direction (as shown by an arrow B) of an intermediate transfer belt 41 in an upper part of an intermediate transfer belt unit 32 described later.

The intermediate transfer belt unit 32 of the printing section 3 includes a driving roller 42 driven by a not shown driving unit, a tension roller 43 applying a tension to the intermediate transfer belt 41 by a biasing member such as a coil spring or the like, and a secondary transfer backup roller 44 disposed so as to face a secondary transfer roller 46. The secondary transfer backup roller 44 and the secondary transfer roller 46 form the secondary transfer portion 47. The intermediate transfer belt 41 is wound around the driving roller 42, the tension roller 43, and the secondary transfer backup roller 44. The intermediate transfer belt unit 32 further includes four primarily transfer rollers 45 disposed so as to face photosensitive drums 33 of the respective process units 31. Predetermined voltages are applied to the primarily transfer rollers 45 so that toner images (i.e., developer images) of respective colors on the photosensitive drums 33 are transferred in a superimposing manner onto the intermediate transfer belt 41.

The intermediate transfer belt unit 32 primarily transfers the toner images of respective colors (formed by the image forming section 30) in a superimposing manner onto the intermediate transfer belt 41 as described above, and conveys the primarily transferred toner image to the secondary transfer portion 47. In the secondary transfer portion 47, the secondary transfer roller 46 applied with a predetermined voltage transfers the toner image (primarily transferred to the intermediate transfer belt 41) to the label 5*b* of the conveyed roll paper 5 supplied by the introducing guide section 2. For this purpose, a timing of conveyance of the roll paper 5 is adjusted while the roll paper 5 is conveyed along the conveyance roller pairs 34, 35 and 36 and the optical sheet sensor 40.

The printing section 3 includes a fixing device 37 including therein a fixing unit 210 and a pressing unit 310. The fixing device 37 applies heat and pressure to the toner image on the label 5*b* of the roll paper 5 conveyed through the secondary transfer portion 47. The toner image is molten and fixed to the roll paper 5. Then, the roll paper 5 is conveyed by ejection rollers 38 and 39 to outside the printer 1.

An X-axis, a Y-axis and a Z-axis shown in FIG. 1 are defined as follows. The X-axis is defined as being parallel to a conveyance direction of the roll paper 5 (shown by the arrow A) when the roll paper 5 passes the secondary transfer portion 47 and the fixing device 37. The Y-axis is defined as being parallel to a direction of rotation axes of the conveyance roller pairs 34, 35 and 36. The Z-axis is defined as being perpendicular to the X-axis and the Y-axis. In other figures, the X-axis, the Y-axis and the Z-axis indicate the same directions as those in FIG. 1. That is, the X-axis, the Y-axis and the Z-axis in other figures indicate orientations when elements shown in the respective figures are assembled into the printer 1 shown in FIG. 1. In this example, the Z-axis is a oriented in a substantially vertical direction.

Figure 3:
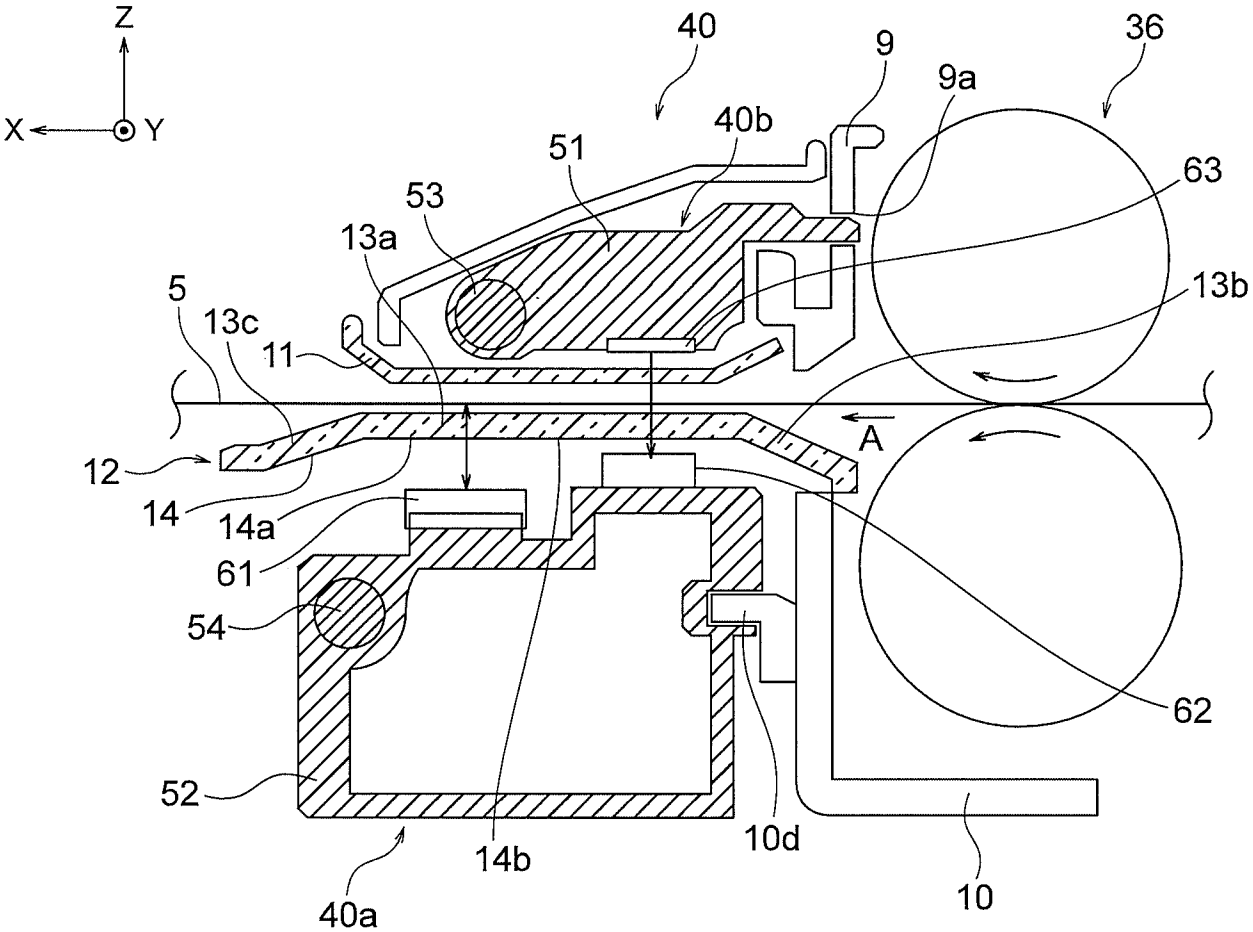
FIG. 3 is an enlarged view showing a part including an optical sheet sensor and a conveyance roller pair shown in FIG. 1.

FIG. 3 is an enlarged view showing a portion including the optical sheet sensor 40 and the conveyance roller pair 36 shown in FIG. 1.

The optical sheet sensor 40 includes an upper carriage 51 disposed above the conveyance path of the roll paper 5, and a lower carriage 52 disposed below the conveyance path of the roll paper 5. The upper carriage 51 engages with an upper screw shaft 53 extending in the direction of the rotation axes of the conveyance roller pair 36 (i.e., the Y-axis direction). The upper carriage 51 is supported by a sub chassis 9 so that the upper carriage 51 is slidable in the direction of the Y-axis. The lower carriage 52 engages with a lower screw shaft 54 extending in the direction of the rotation axes of the conveyance roller pair 36 (i.e., the Y-axis direction). The lower carriage 52 is supported by a unit chassis 10 (i.e., a chassis) so that the lower carriage 52 is slidable in the direction of the Y-axis. In this example, a pitch of a screw of the upper screw shaft 53 is the same as a pitch of a screw of the lower screw shaft 54.

A portion of the upper carriage 51 opposite to the upper screw shaft 53 is guided by a guide hole 9*a* extending parallel with the upper screw shaft 53. The upper carriage 51 slides in the Y-axis direction according to a rotation of the upper screw shaft 53. During sliding of the upper carriage 51, the upper carriage 51 maintains its orientation so that a light emitting element 63 held on a lower surface of the upper carriage 51 faces an upper surface of the roll paper 5 on the conveyance path. Hereinafter, the light emitting element 63 and the upper carriage 51 holding the light emitting element 63 may be referred to as a sensor sub unit 40*b*.

A portion of the lower carriage 52 opposite to the lower screw shaft 54 is guided by a guide protrusion 10*d* extending parallel with the lower screw shaft 54. The lower carriage 52 slides in the Y-axis direction according to a rotation of the lower screw shaft 54. During sliding of the lower carriage 52, the lower carriage 52 maintains its orientation so that a light emitting/receiving unit 61 and a light receiving element 62 held on an upper surface of the lower carriage 52 faces a lower surface of the roll paper 5 on the conveyance path. A position of the light receiving element 62 in the conveyance direction of the roll paper 5 shown by the arrow A (i.e., the X-axis direction) is aligned with a position of the light emitting element 63 in the conveyance direction of the roll paper 5. Hereinafter, the light emitting/receiving unit 61, the light receiving element 62 and the upper carriage 51 holding the light emitting/receiving unit 61 and the light receiving element 62 may be referred to as a sensor cover main unit 40*a*. Here, a light emitting element of the light emitting/receiving unit 61 or the light receiving element 62 corresponds to an optical sensor.

Positions of the upper carriage 51 and the lower carriage 52 are individually adjusted in the Y-axis direction so that the light emitting element 63 of the upper carriage 51 and the light receiving element 62 of the lower carriage 52 face each other. After the positions of the upper carriage 51 and the lower carriage 52 are adjusted, the screw shafts 53 and 54 are rotated at the same speed and in the same direction by a connection adjusting portion (not shown). By operating the connection adjusting portion, the upper carriage 51 and the lower carriage 52 slide in the Y-axis direction (i.e., a widthwise direction of the roll paper 5) above and below the conveyance path. The upper carriage 51 and the lower carriage 52 slide together with each other, while maintaining a positional relationship therebetween.

An upper guide plate 11 is disposed between the upper carriage 51 and the roll paper 5 passing through the optical sheet sensor 40. The upper guide plate 11 guides an upper side of the roll paper 5 along the conveyance path. The upper guide plate 11 is transparent, and transmits light emitted by the light emitting element 63. Similarly, a sensor cover 12 is disposed between the lower carriage 52 and the roll paper 5. The sensor cover 12 guides a lower side of the roll paper 5 along the conveyance path. The sensor cover 12 is transparent, and transmits light emitted by the light emitting/receiving unit 61. A configuration of the sensor cover 12 will be described later.

Figure 4:
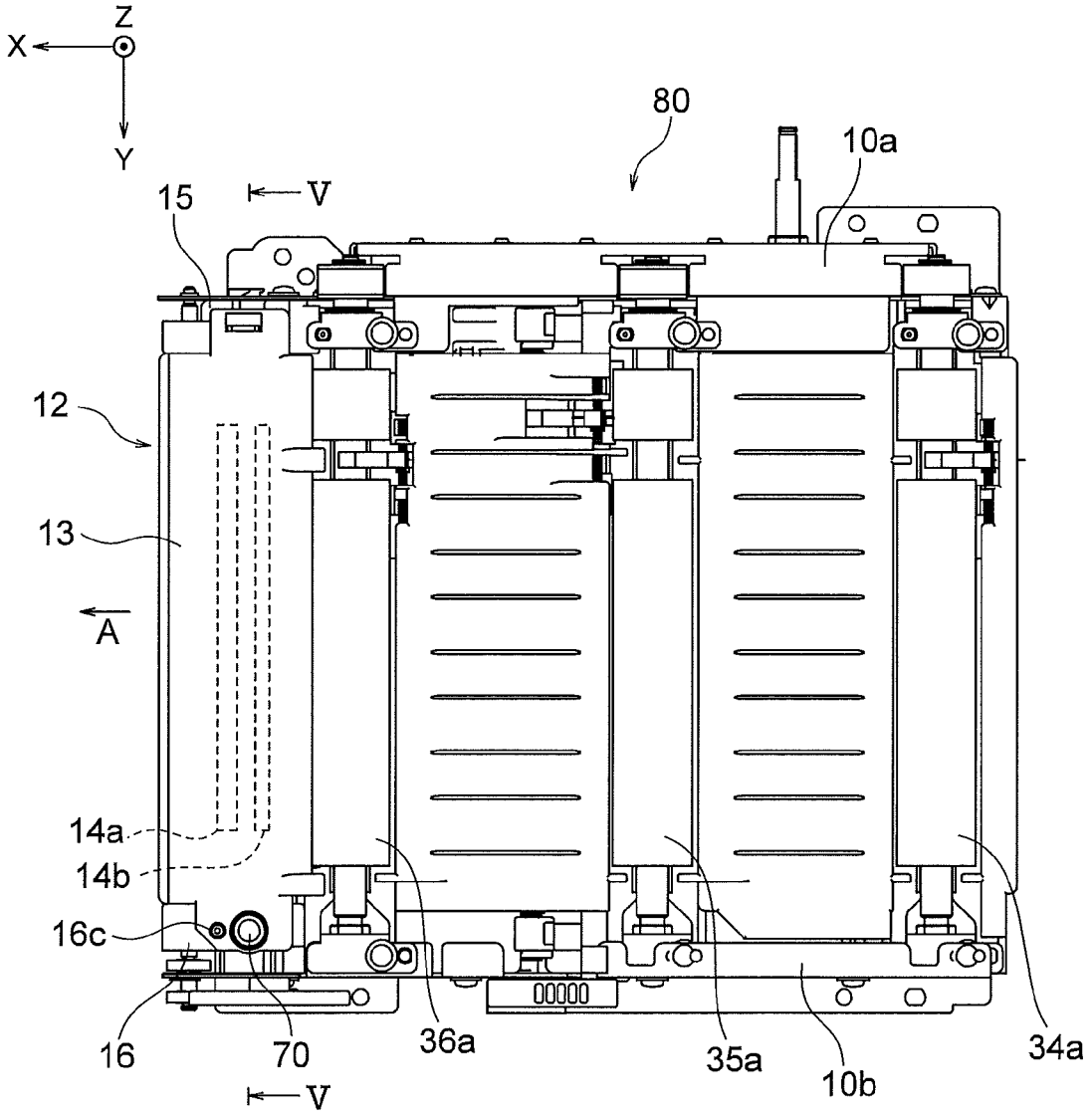
FIG. 4 is a plan view showing a conveyance unit including main parts such as the conveyance roller pairs and the optical sheet sensor.
Figure 5:
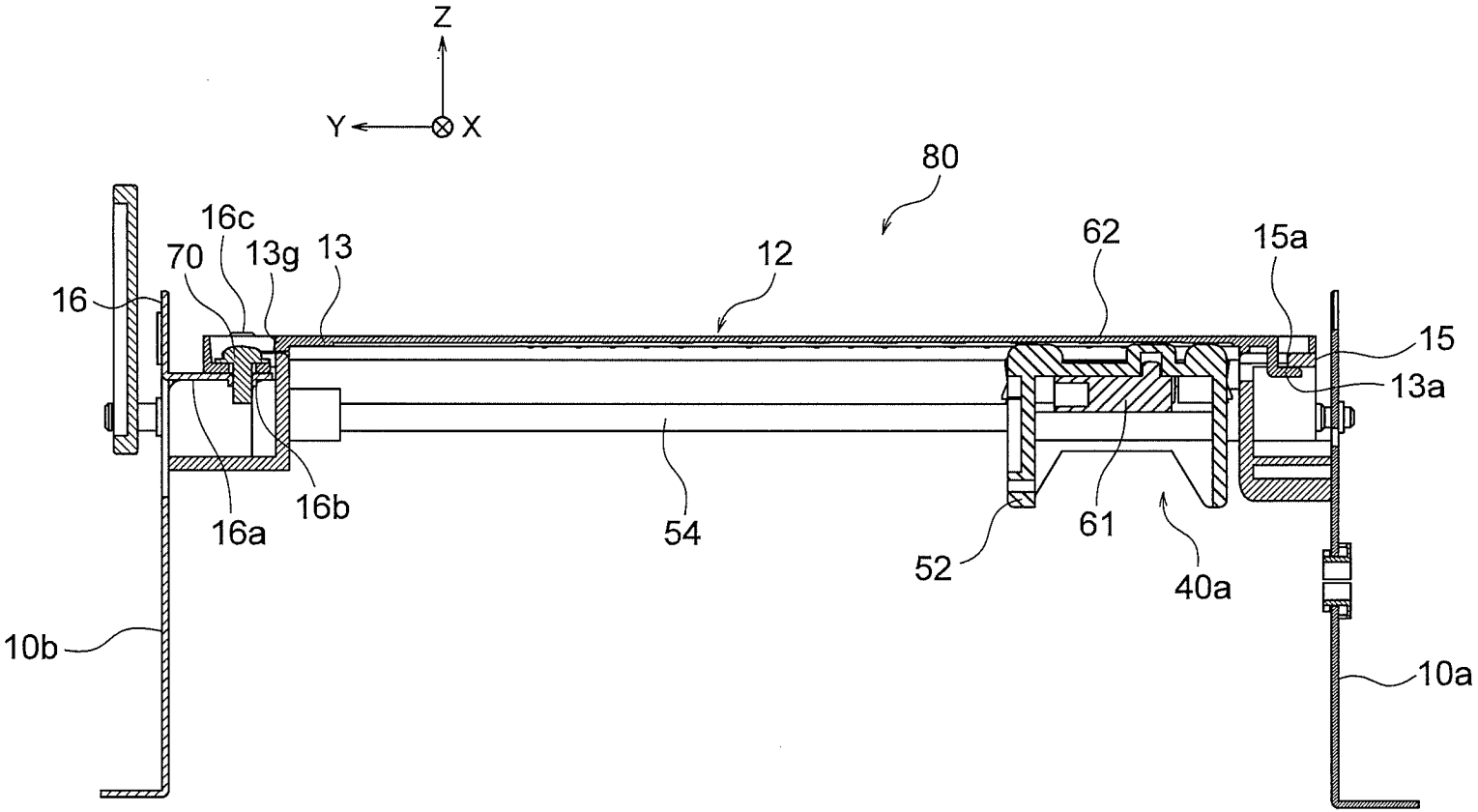
FIG. 5 is a sectional view taken along line V-V shown in FIG. 4.
Figure 6:
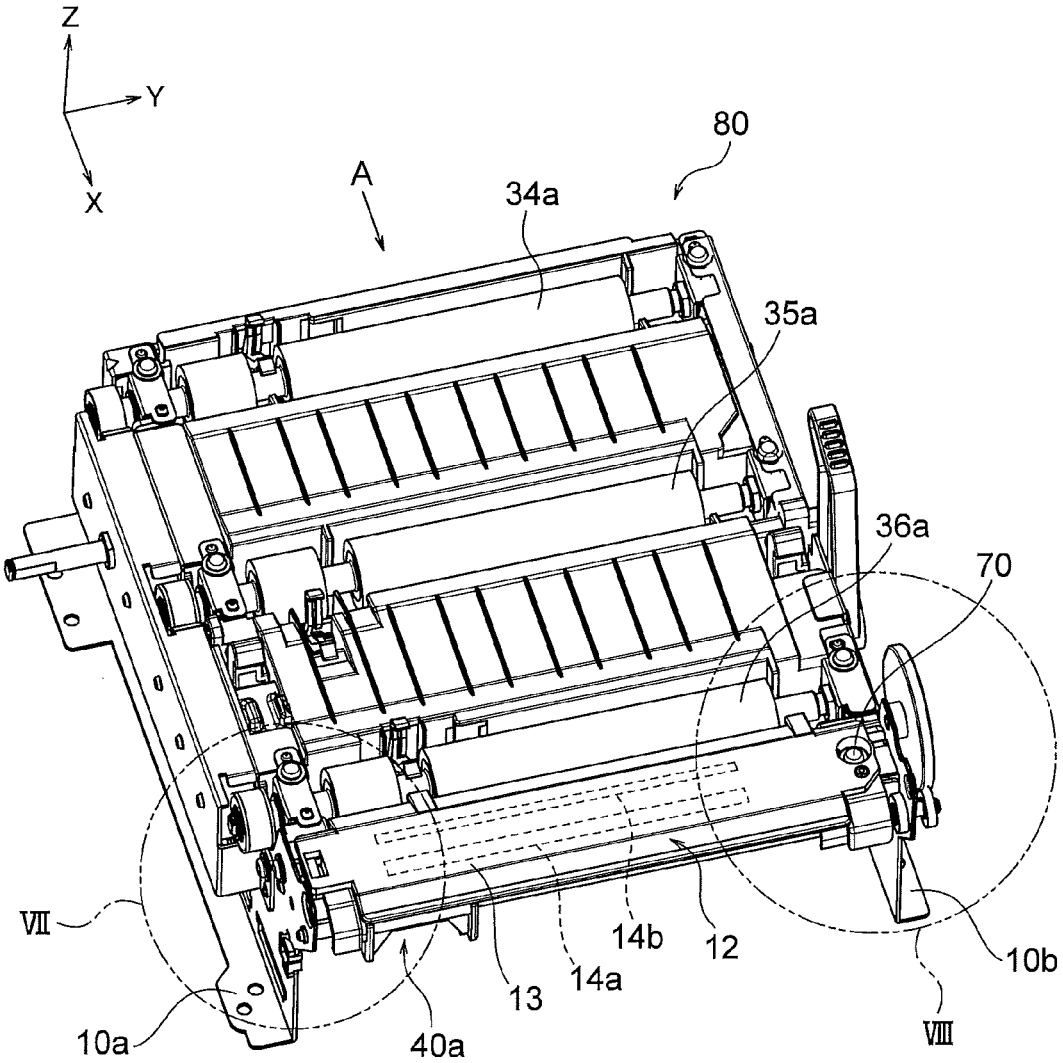
FIG. 6 is a perspective view showing an external shape of the conveyance unit.
Figure 7:
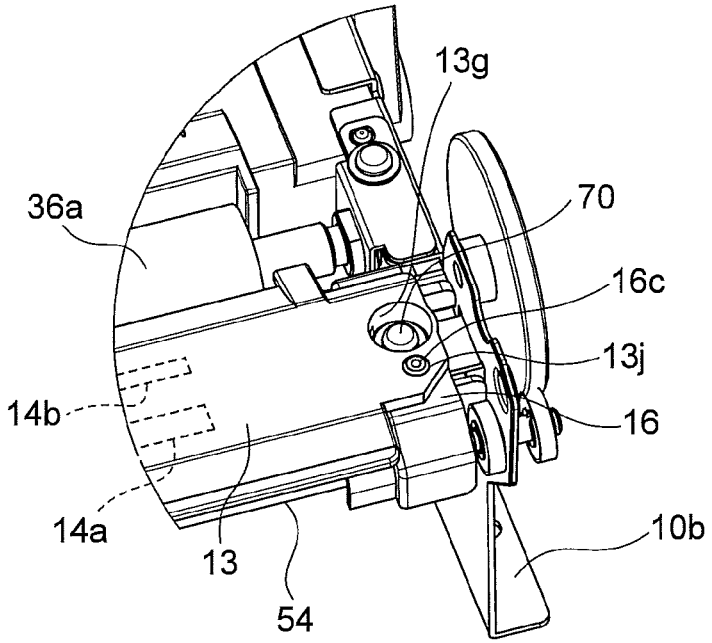
FIG. 7 is an enlarged view showing a part surrounded by a circle VII in FIG. 6.
Figure 8:
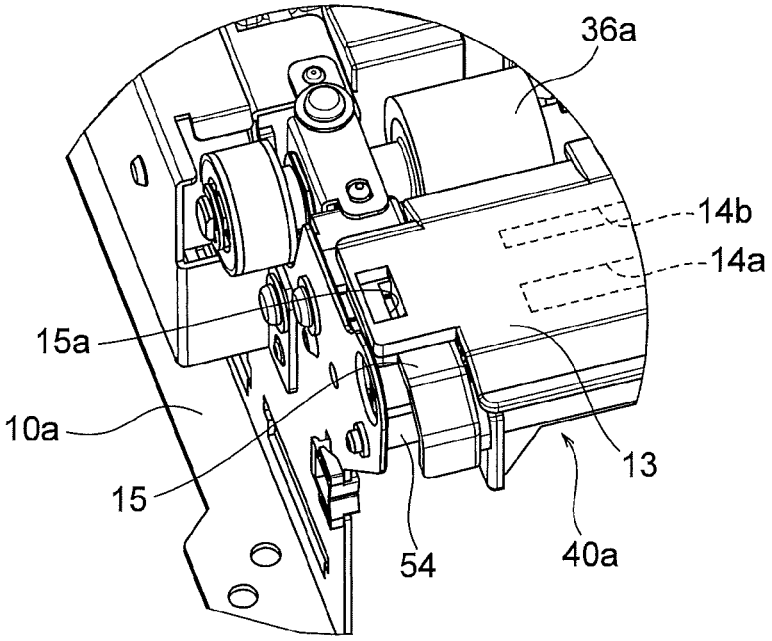
FIG. 8 is an enlarged view showing a part surrounded by a circle VIII in FIG. 6.

FIG. 4 is a plan view of a conveyance unit 80 including main parts such as conveyance roller pairs 34, 35 and 36, the optical sheet sensor 40 and the like. FIG. 5 is a sectional view taken along line V-V in FIG. 4. FIG. 6 is a perspective view showing an external shape of the conveyance unit 80. FIG. 7 is an enlarged view showing a part surrounded by a circle VII in FIG. 6. FIG. 8 is an enlarged view showing a part surrounded by a circle VIII in FIG. 6. As shown in FIGS. 4-8, the conveyance unit 80 does not include a portion above the conveyance path, i.e., the upper carriage 51 (FIG. 3) of the optical sheet sensor 40, upper rollers of the conveyance roller pairs 34, 35 and 36, and the like.

In the conveyance unit 80, driving rollers (i.e., lower rollers) 34*a*, 35*a* and 36*a* of the conveyance roller pairs 34, 35 and 36 are arranged in this order from upstream in the conveyance direction of the roll paper 5 shown by the arrow A. Further, the sensor cover 12 and the sensor cover main unit 40*a* are disposed downstream of the driving roller 36*a* of the conveyance roller pair 36. The sensor cover 12 and the sensor cover main unit 40*a* are parts of the optical sheet sensor 40 lower than the conveyance path of the roll paper 5.

The lower screw shaft 54 (FIG. 5) extends in the direction of the rotation axes of the conveyance roller pair 36 (i.e., the Y-axis direction), and is rotatably supported by a unit chassis 10 having side wall portions 10*a* and 10*b* facing each other. The sensor cover main unit 40*a* is linearly movable in the Y-axis direction according to the rotation of the lower screw shaft 54 as described above.

The lower carriage 52 of the sensor cover main unit 40*a* holds the light emitting/receiving unit 61 and the light receiving element 62. The light emitting/receiving unit 61 and the light receiving element 62 are held at positions displaced from each other in the conveyance direction of the roll paper 5 shown by the arrow A, i.e., the X-axis direction, as shown in FIG. 3. The light emitting/receiving unit 61 includes a light emitting element and a light receiving element. The light emitting/receiving unit 61 is so held that light emitted by the light emitting element is reflected by the roll paper 5 conveyed along the conveyance path, and is incident on the light receiving element. The light receiving element 62 is so held that light emitted by the light emitting element 63 of the sensor sub unit 40*b* (FIG. 3) disposed above the conveyance path of the roll paper 5 is incident on the light receiving element 62.

The sensor cover 12 is formed of resin such as polycarbonate or the like that transmits visible light. As shown in FIGS. 3 through 6, the sensor cover 12 is disposed between the sensor cover main unit 40*a* and the roll paper 5 conveyed along the conveyance path, and extends in the direction of the rotation axes of the conveyance roller pair 36 (i.e., the Y-axis direction). As shown in FIG. 3, the sensor cover 12 includes a sheet guide portion 13*a*, an introducing portion 13*b*, and a lead-out portion 13*c*. The sheet guide portion 13*a* is flat, and guides the lower surface of the roll paper 5. The introducing portion 13*b* extends upstream from the sheet guide portion 13*a* in the conveyance direction, and is inclined so that distance from the conveyance path increases toward an upstream side. The lead-out portion 13*c* extends downstream from the sheet guide portion 13*a* in the conveyance direction, and is inclined so that distance from the conveyance path increases toward a downstream side. Both ends of the sensor cover 12 are fixed to the side wall portions 10*a* and 10*b* of the unit chassis 10 as described later.

Figure 9A:
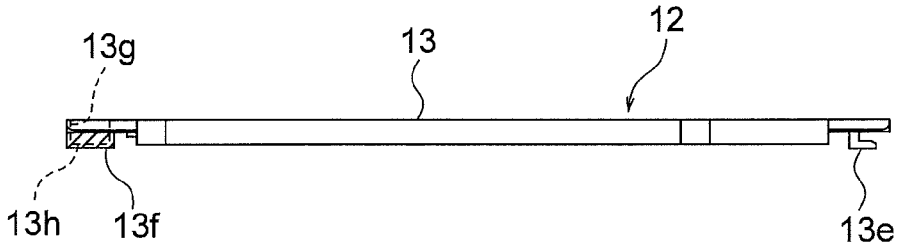
FIG. 9A is a front view showing a shape of a sensor cover as seen in a conveyance direction of a recording medium (as indicated by an arrow A in FIG. 6)
Figure 9B:
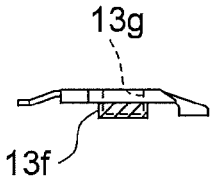
FIG. 9B is a left side view showing the shape of the sensor cover.
Figure 9C:
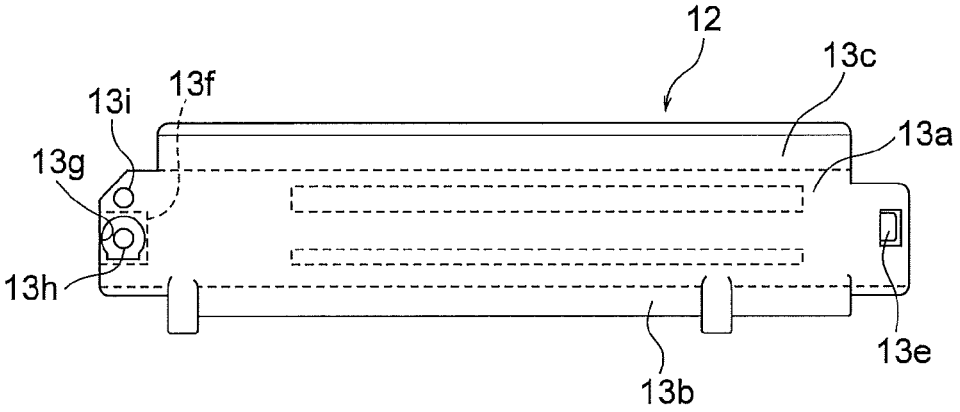
FIG. 9C is a plan view showing the shape of the sensor cover
Figure 9D:
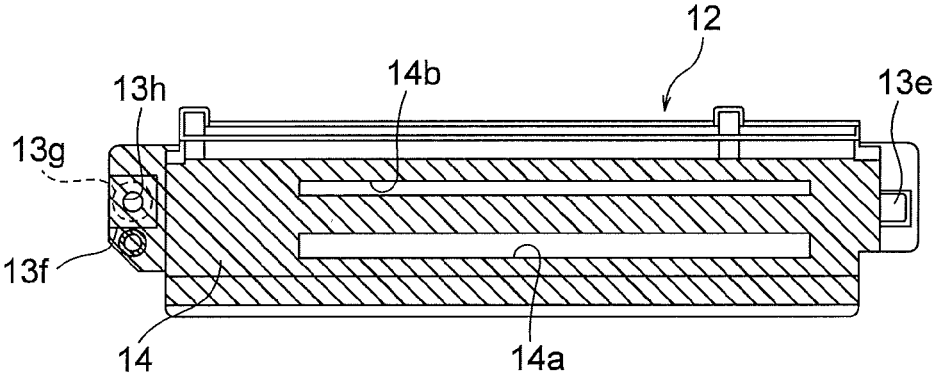
FIG. 9D is a bottom view showing the shape of the sensor cover.

FIG. 9A is a front view showing a shape of the sensor cover 12 as seen in the conveyance direction of the roll paper 5 (as shown by the arrow A in FIG. 6). FIG. 9B is a left side view showing the shape of the sensor cover 12. FIG. 9C is a plan view showing the shape of the sensor cover 12. FIG. 9D is a bottom view showing the shape of the sensor cover 12.

As shown in FIGS. 3 and 9D, the sensor cover 12 includes a sensor cover main body 13 and an aluminum deposition layer 14 (shown by hatching in FIG. 9D). The aluminum deposition layer 14 as an electrically conductive surface (or an electrically conductive layer) is formed entirely on a lower surface of the sensor cover main body 13 facing the sensor cover main unit 40*a*. In this regard, the lower surface of the sensor cover main body 13 facing the optical sheet sensor 40 is also referred to as a first surface. The aluminum deposition layer 14 (i.e., a conductive layer) is formed on the first surface of the sensor cover main body 13. The first surface of the sensor cover main body 13 corresponds to a first side of the sensor cover 12. The aluminum deposition layer 14 includes a first light transmitting portion 14*a* and a second light transmitting portion 14*b* both of which transmit light. The first light transmitting portion 14*a* and the second light transmitting portion 14*b* are formed by not depositing aluminum.

As shown in FIG. 3, the first light transmitting portion 14*a* transmits light emitted by the light emitting/receiving unit 61 toward the roll paper 5, and also transmits light reflected by the roll paper 5. The first light transmitting portion 14*a* extends in a moving direction of the sensor cover main unit 40*a* so as to cover a movable range of the light emitting/receiving unit 61 (see FIGS. 4 and 9D). The second light transmitting portion 14*b* transmits light emitted by the light emitting element 63 of the sensor sub unit 40*b* toward the light receiving element 62 of the sensor cover main unit 40*a*. The second light transmitting portion 14*b* extends in the moving direction of the sensor cover main unit 40*a* so as to cover a movable range of the light receiving element 62 (see FIGS. 4 and 9D). On the sheet guide portion 13*a* of the sensor cover main body 13, the first light transmitting portion 14*a* and the second light transmitting portion 14*b* extend adjacent to each other and parallel with the moving direction of the sensor cover main unit 40*a*.

Next, a mounting method of the sensor cover 12 to the unit chassis 10 will be described.

As shown in FIGS. 9A through 9D, an engagement claw 13*e* is formed at an end portion of the sensor cover main body 13. The engagement claw 13*e* extends downward and is bent in an L-shape. An engagement portion 13*f* is formed at the other end portion of the sensor cover main body 13. The engagement portion 13*f* has a lower surface at a downwardly protruding position.

The engagement portion 13*f* includes a concave portion 13*g* having an opening on an upper side of the engagement portion 13*f*. The concave portion 13*g* houses a head of a fixing screw 70 (FIG. 5) therein. A fixing hole 13*h* is formed on a bottom of the concave portion 13*g*. A screw portion of the fixing screw 70 penetrates the fixing hole 13*h*. A positioning hole 13*i* is formed adjacent to the engagement portion 13*f*. As shown in FIG. 9D, the aluminum deposition layer 14 is formed on a lower surface of the engagement portion 13*f* continuously with the aluminum deposition layer 14 formed on other portions.

As shown in FIG. 5, a first placement portion 15 is provided on the side wall portion 10*a* of the unit chassis 10. An end side of the sensor cover main body 13 is placed on the first placement portion 15. An engagement hole 15*a* is formed on the first placement portion 15. The engagement claw 13*e* of the sensor cover main body 13 is fit into the engagement hole 15*a* of the first placement portion 15 as described later.

A second placement portion 16 (FIG. 7) is provided on the side wall portion 10*b* of the unit chassis 10. The other end side of the sensor cover main body 13 is placed on the second placement portion 16. A concave portion 16*a* (FIG. 5) and a screw hole 16*b* are formed on the second placement portion 16. The concave portion 16*a* receives the engagement portion 13*f* of the sensor cover main body 13. The screw hole 16*b* is formed on a bottom portion of the concave portion 16*a*, and engages the fixing screw 70. A positioning protrusion 16*c* is formed in the vicinity of the concave portion 16*a*. The positioning protrusion 16*c* is fit into the positioning hole 13*i* of the sensor cover main body 13.

With such a configuration, when the sensor cover 12 is fixed to the unit chassis 10, the engagement claw 13*e* is inserted into the engagement hole 15*a* of the first placement portion 15 from above. Then, as shown in FIG. 5, an end portion of the sensor cover 12 is placed on the first placement portion 15 in such a manner the engagement claw 13*e* contacts a lower surface of the first placement portion 15. In this way, the position of the sensor cover 12 is determined in the Z-axis direction and the X-axis direction. For this purpose, the engagement claw 13*e* and the engagement hole 15*a* are formed to have widths so as not to leave play more than necessary in the X-axis direction.

Then, as shown in FIG. 7, the other end portion of the sensor cover 12 is placed on the second placement portion 16 in such a manner that the positioning protrusion 16*c* of the second placement portion 16 is fit into the positioning hole 13*i* of the sensor cover main body 13. In this way, the position of the sensor cover 12 relative to the unit chassis 10 is determined in all directions. In this state, the fixing hole 13*h* (FIG. 9C) of the engagement portion 13*f* of the sensor cover 12 and the screw hole 16*b* (FIG. 5) of the second placement portion 16 are substantially aligned with each other.

Then, the fixing screw 70 is inserted through the fixing hole 13*h* from the concave portion 13*g* of the engagement portion 13*f*, and is brought into engagement with the screw hole 16*b* of the second placement portion 16, so that the sensor cover 12 is fixed to the unit chassis 10.

In this state, as shown in FIGS. 5 and 7, the head of the fixing screw 70 is housed in the concave portion 13*g* of the engagement portion 13*f*, and does not protrudes from an upper surface of the sensor cover 12. Further, the aluminum deposition layer 14 (FIG. 9D) formed on the lower surface of the sensor cover main body 13 is electrically connected to the second placement portion 16, and is therefore electrically connected to the unit chassis 10 electrically connected to the second placement portion 16. In this regard, the unit chassis 10 is electrically connected to a main chassis 1*a* (i.e., a main body) of the printer 1 by being fixed to the main chassis 1*a* of the printer 1. Further, the main chassis 1*a* of the printer 1 is grounded via an AC power supply.

Here, description will be made of a case where the light emitting/receiving unit 61 of the sensor cover main unit 40*a* detects the eye mark 5*c* formed on the lower surface (i.e., the back surface) of the roll paper 5 (FIG. 2) conveyed in the conveyance direction (shown by the arrow A) along the conveyance path as shown in FIG. 3.

As described above, when the screw shafts 53 and 54 are rotated at the same speed and in the same direction using the connection adjusting portion (not shown), the sensor cover main unit 40*a* and the sensor sub unit 40*b* move in the Y-axis direction while maintaining a predetermined positional relationship. Positions of the sensor cover main unit 40*a* and the sensor sub unit 40*b* are adjusted so that the light emitted by the light emitting/receiving unit 61 is incident on and is reflected by the lower surface of the roll paper 5 at a passing position of the eye mark 5*c* of the roll paper 5.

Therefore, an amount of light received by the light emitting/receiving unit 61 when the light is reflected at the eye mark 5*c* is different from an amount of light received by the light emitting/receiving unit 61 when the light is reflected by other portions of the roll paper 5. A passage of the eye mark 5*c* can be detected based on a difference in the amount of light. The detection of the passage of the eye mark corresponds to a detection of position information of the roll paper 5. Operation timings of the printer 1 or the like can be controlled based on the detected position information of the roll paper 5.

In this regard, there is a case where a plurality of cut-form papers are conveyed along the conveyance path. In such case, when the light emitting/receiving unit 61 receives reflected light, the light emitting/receiving unit 61 detects presence of the cut-form paper and also detects position information of the cut-form paper. Further, when the light receiving element 62 receives light proceeding from the light emitting element 63 across the conveyance path, the light emitting element 63 detects a sheet-to-sheet interval and also detects position information of the sheet-to-sheet interval.

Next, description will be made of static electricity generated when the roll paper 5 moves on the sensor cover 12 while being guided by the sensor cover 12, an unfavorable effect of the static electricity, and a measure against the static electricity.

Figure 10A:
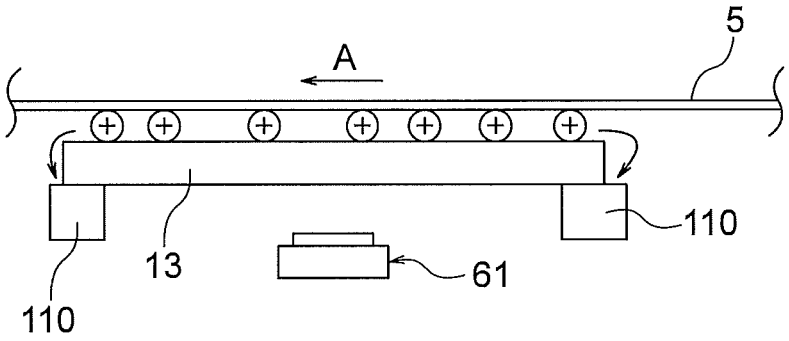
FIG. 10A is a schematic view for illustrating static electricity generated when a roll paper moves on the sensor cover in the case where no aluminum deposition layer is formed on a lower surface of the sensor cover.
Figure 10B:
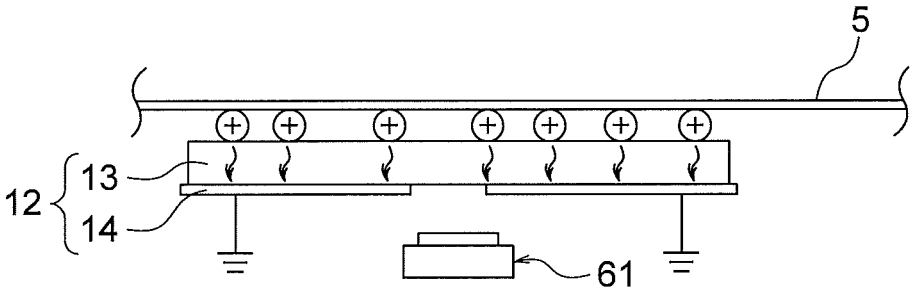
FIG. 10B is a schematic view for illustrating static electricity generated when the roll paper moves on the sensor cover in the case where an aluminum deposition layer is formed on the lower surface of the sensor cover.

FIGS. 10A and 10B are schematic views for illustrating the static electricity generated when the roll paper 5 moves on the sensor cover 12 in the conveyance direction (as shown by the arrow A). FIG. 10A shows a case where the sensor cover has no aluminum deposition layer, i.e., where no aluminum deposition layer is formed on the lower surface of the sensor cover main body 13. FIG. 10B shows a case where the sensor cover 12 of Embodiment 1 is used, i.e., where the aluminum deposition layer 14 is formed on the lower surface of the sensor cover main body 13. The lower surface of the sensor cover main body 13 is a surface that does not contact the roll paper 5, and is opposite to a surface where the static electricity is generated by contact with the roll paper 5. In this regard, if the aluminum deposition layer 14 is formed on the surface contacting the roll paper 5, the aluminum deposition layer 14 may be peeled off from the sensor cover main body 13 at a bonding surface by contact friction or the like. Such a failure can be prevented by forming the aluminum deposition layer 14 on the surface that does not contact the roll paper 5.

When the roll paper 5 slides on the sensor cover main body 13 formed of resin such as, for example, polycarbonate or the like that transmits light, static electricity (more specifically, positive electrical charge) is generated at a contact portion between the sensor cover main body 13 and the roll paper 5 as shown in FIG. 10A, and discharge may occur between the contact portion and the unit chassis 10. When such discharge occurs, discharge noise intrudes into the light emitting element and the light receiving element of the light emitting/receiving unit 61 and an electrical system such as connection wirings or the like for the light emitting/receiving unit 61. As a result, the discharge noise may intrude into a detection signal outputted by the light emitting/receiving unit 61, i.e., an electric signal converted from light received by the light receiving element of the light emitting/receiving unit 61. Therefore, detection accuracy may be deteriorated.

Here, although it has been described that the positive electrical charge is accumulated in the contact portion between the sensor cover main body 13 and the roll paper 5, negative electrical charge may be accumulated in the contact portion depending on a combination of materials of the sensor cover main body 13 and the roll paper 5.

As shown in FIG. 10B, the sensor cover 12 of Embodiment 1 includes the aluminum deposition layer 14 deposited on the lower surface of the sensor cover main body 13, and the aluminum deposition layer 14 is electrically connected to the unit chassis 10 for the purpose of suppressing discharge noise.

With such a configuration, as shown in FIG. 10B, electrical charge generated on the contact portion between the sensor cover main body 13 and the roll paper 5 is released to the unit chassis 10 via a resin layer between the upper surface and the lower surface of the sensor cover main body 13 whose electrical resistance decreases. Therefore, generation of discharge can be suppressed.

Figure 11A:
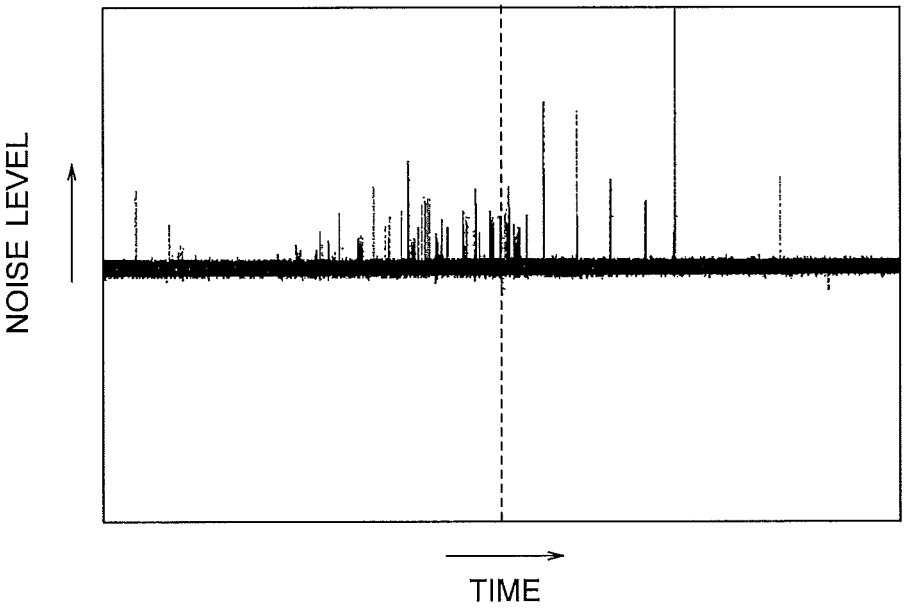
FIG. 11A is a graph showing a measurement result of a noise level of a detection signal outputted from a light receiving element of a light emitting/receiving unit in the case where the sensor cover with no aluminum deposition layer as shown in FIG. 10A is mounted to the printer.
Figure 11B:
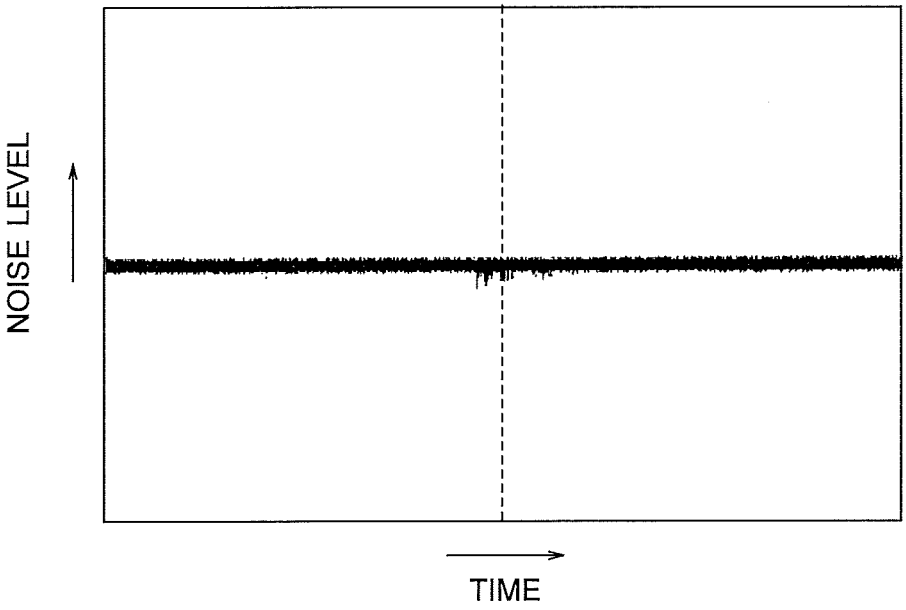
FIG. 11B is a graph showing a measurement result of the noise level of the detection signal outputted from the light receiving element of the light emitting/receiving unit in the case where the sensor cover with the aluminum deposition layer as shown in FIG. 10B is mounted to the printer.
Figure 12A:
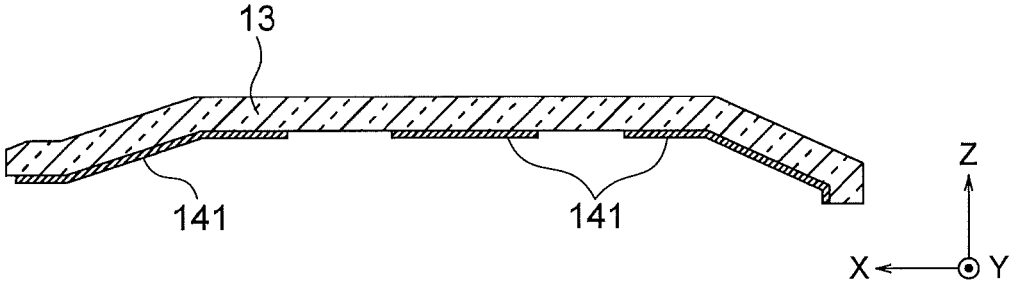
FIGS. 12A, 12B, 12C and 12D are sectional views showing modifications of Embodiment 1.
Figure 12B:
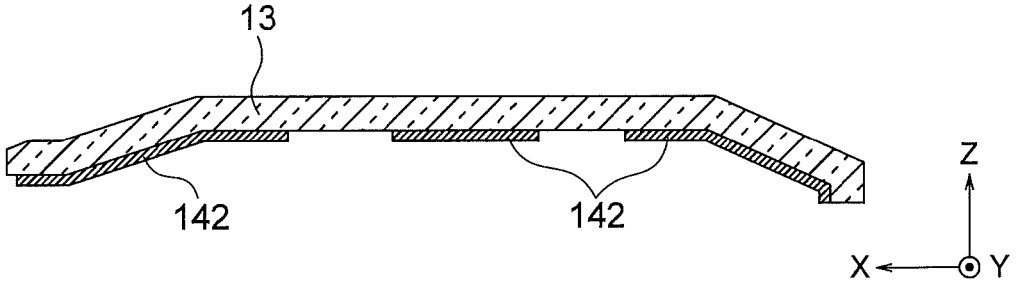
Figure 12C:
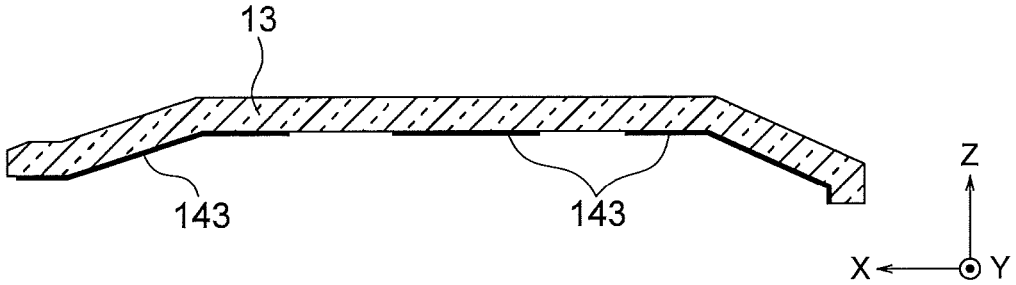
Figure 12D:
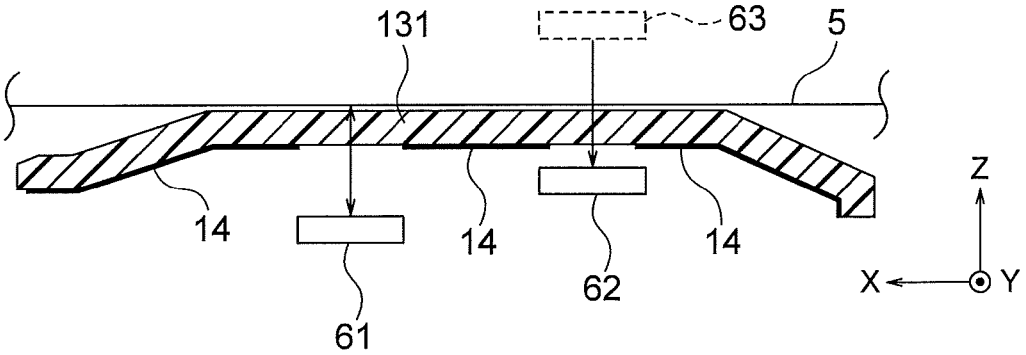

FIG. 11A is a graph showing a measurement result 1 of a measurement experiment 1. In the measurement experiment 1, the sensor cover (FIG. 10A) having no aluminum deposition layer 14 on the sensor cover main body 13 is mounted to the printer 1, and a noise level of the detection signal of the light receiving element of the light emitting/receiving unit 61 (i.e., electrical signal converted from the light received by the light receiving element) is measured. FIG. 11B is a graph showing a measurement result 2 of a measurement experiment 2. In the measurement experiment 2, the sensor cover 12 of Embodiment 1 having the aluminum deposition layer 14 (FIG. 10A) on the sensor cover main body 13 is mounted to the printer 1, and a noise level of the detection signal of the light receiving element of the light emitting/receiving unit 61 (i.e., electrical signal converted from the light received by the light receiving element) is measured.

In this regard, conditions (for example, a conveyance amount of the roll paper 5 until start of measurement) of the measurement experiments 1 and 2 are the same. The noise level is measured without causing the light emitting element to emit light in either of the measurement experiments 1 and 2. Further, scale of the graphs (FIGS. 11A and 11B) are the same.

From the results of the measurement experiments 1 and 2, it is understood that the discharge noise is generated in the measurement experiment 1 using the sensor cover having no aluminum deposition layer 14, but the discharge noise is suppressed in the measurement experiment 2 using the sensor cover 12 having the aluminum deposition layer 14.

In Embodiment 1, description has been made of suppression of the discharge noise generated in the detection signal of the light emitting/receiving unit 61. However, discharge noise in the detection signal of the light receiving element 62 based on transmitted light is also suppressed for the same reason.

Further, the sensor cover 12 of Embodiment 1 will be further considered.

(1) The sensor cover main body 13 is formed of resin, and has a high electrical resistance (for example, a volume resistivity of $10^{15}\Omega$ to $10^{16}\Omega$). Therefore, even when the sensor cover 12 is disposed in the vicinity of the secondary transfer portion 47 where transfer is performed at a high voltage of several thousands of volts, the sensor cover 12 does not affect the transfer. For example, the sensor cover 12 does not cause leakage of transfer current.

(2) The discharge noise may be suppressed by forming the sensor cover main body 13 of electrically conductive resin, and grounding the sensor cover main body 13 via a high voltage of approximately 500 MΩ. However, the electrically conductive resin has low and uneven transparency, and therefore the electrically conductive resin is not suitable for use in the optical sensor. The sensor cover 12 of Embodiment 1 solves such a problem.

(3) The discharge noise may be suppressed by applying an electrically conductive coating on the upper surface (i.e., the conveyance path side) of the sensor cover main body 13 except for portions where light passes, and grounding an end portion of the coating. However, the electrically conductive coating may be peeled off by sliding contact. Therefore, electrical conductivity may be reduced, and the discharge noise may be generated. Further, the sensor cover main body 13 with the electrically conductive coating may cause leakage of the transfer current, and therefore cannot be disposed in the vicinity of the transfer portion. The sensor cover 12 of Embodiment 1 solves such a problem.

(4) The discharge noise may be suppressed by forming an aluminum deposition layer on the upper surface (i.e., the conveyance path side) of the sensor cover main body 13 except for portions where light passes, and grounding an end portion of the aluminum deposition layer. However, the aluminum deposition layer has low abrasion resistance property, and may be peeled off as is the case with the electrically conductive coating. Therefore, electrical conductivity may be reduced, and the discharge noise may be generated. The sensor cover 12 of Embodiment 1 solves such a problem.

(5) An electrode having a predetermined area or larger is attached to the lower surface (i.e., the light emitting/receiving unit 61 side) of the sensor cover main body 13. Therefore, a condenser is formed, and the static electricity is prevented from being discharged to other elements.

(6) The accumulated electrical charge is released via a high resistance region of the sensor cover main body 13. Therefore, abrupt electrical charge migration due to the discharge can be prevented, and generation of discharge noise can be suppressed.

(7) A ground shield can be formed by disposing a low-electrical-resistance member (i.e., the aluminum deposition layer 14) on the lower surface (i.e., the light emitting/receiving unit 61 side) of the sensor cover main body 13, and electrically connecting the low-electrical-resistance member directly to the unit chassis 10. The ground shield can shield the light receiving element from noise intrusion from outside.

Although description has been made of an example in which the aluminum deposition layer 14 is formed on the lower surface of the sensor cover main body 13, Embodiment 1 is not limited to such an example.

FIGS. 12A through 12D are sectional views cut along a plane perpendicular to the Y-axis direction. In a modification shown in FIG. 12A, a metal tape 141 is bonded to the lower surface of the sensor cover main body 13, and is electrically connected with the unit chassis 10 (FIG. 3). In a modification shown in FIG. 12B, a metal plate 142 is attached to the lower surface of the sensor cover main body 13, and is electrically connected with the unit chassis 10 (FIG. 3). In a modification shown in FIG. 12C, an electrically conductive coating 143 having substantially the same electrical resistance as the aluminum deposition layer 14 is applied to the lower surface the sensor cover main body 13, and is electrically connected with the unit chassis 10 (FIG. 3).

Although description has been made of an example in which the roll paper 5 is used as the recording medium, and the optical sheet sensor 40 detects the eye mark 5*c* of the roll paper 5, Embodiment 1 is not limited to such an example. It is also possible to use a cut-form paper or a film of a general size. In such a case, the optical sheet sensor 40 may be configured to detect presence/absence of the cut-form paper or film.

Although description has been made of an example where the sensor cover main body 13 is formed of material that transmits visible light, Embodiment 1 is not limited to such an example. For example, it is only necessary that the sensor cover main body 13 has transparency to light of a wavelength range to be used. For example, in a modification shown in FIG. 12D, the sensor cover main body 131 is formed of polycarbonate that transmits infrared ray, but does not transmit visible light. The light emitting/receiving unit 61, the light emitting element 63 and the light receiving element 62 are configured to use infrared ray instead of visible light.

As described above, according to the image forming apparatus of Embodiment 1, it becomes possible to prevent intrusion of discharge noise into the detection signal converted from the light received by the light receiving element of the light emitting/receiving unit 61 or the light receiving element 62 due to the static electricity generated on the sensor cover 12 by contact with the roll paper 5. Therefore, it becomes possible to prevent malfunction of the optical sheet sensor 40 due to the noise intrusion.

Although the printer using the roll paper has been described as an example of the image forming apparatus in Embodiment 1, the present invention is also applicable to a printer, a copier, a facsimile machine, a MFP (Multi-Function Peripheral) having these functions, and the like.

While the preferred embodiments of the present invention have been illustrated in detail, it should be apparent that modifications and improvements may be made to the invention without departing from the spirit and scope of the invention as described in the following claims.

What is claimed is:

1. An image forming apparatus configured to form an image on a recording medium, the image forming apparatus comprising:

an optical sensor disposed on a conveyance path of the recording medium, the optical sensor being configured to detect position information of the recording medium conveyed along the conveyance path; and a sensor cover disposed between the optical sensor and the recording medium whose position information is detected by the optical sensor, the sensor cover being configured to guide the recording medium, the sensor cover having a first side facing the optical sensor, wherein the sensor cover includes an electrically conductive surface on the first side, and the electrically conductive surface is electrically connected to a main body of the image forming apparatus.

2. The image forming apparatus according to claim 1, wherein the electrically conductive surface is formed except for a region transmitting light proceeding toward the optical sensor.

3. The image forming apparatus according to claim 1, wherein the sensor cover includes a sensor cover main body having a first surface facing the optical sensor, and wherein the electrically conductive surface is formed by depositing metal having electrical conductivity on the first surface of the sensor cover main body.

4. The image forming apparatus according to claim 1, wherein the sensor cover includes a sensor cover main body having a first surface facing the optical sensor, and wherein the electrically conductive surface is formed by bonding a metal tape having electrical conductivity to the first surface of the sensor cover main body.

5. The image forming apparatus according to claim 1, wherein the sensor cover includes a sensor cover main body having a first surface facing the optical sensor, and wherein the electrically conductive surface is formed by attaching a metal plate having electrical conductivity to the first surface of the sensor cover main body.

6. The image forming apparatus according to claim 1, wherein the sensor cover includes a sensor cover main body having a first surface facing the optical sensor, and wherein the electrically conductive surface is formed by applying an electrically conductive coating to the first surface of the sensor cover main body.

7. The image forming apparatus according to claim 1, wherein the sensor cover includes a sensor cover main body, and wherein the sensor cover main body transmits light of a wavelength range received by the optical sensor.

8. The image forming apparatus according to claim 7, wherein the light received by the optical sensor is visible light, and the sensor cover main body is substantially transparent.

9. The image forming apparatus according to claim 7, wherein the light received by the optical sensor is infrared ray, and the sensor cover main body is formed of polycarbonate that does not transmit visible light.

10. The image forming apparatus according to claim 1, wherein the optical sensor detects light reflected by the recording medium.

11. The image forming apparatus according to claim 1, wherein the optical sensor detects light proceeding across the conveyance path.

12. The image forming apparatus according to claim 1, wherein the recording medium includes an elongated base sheet, a plurality of labels bonded to the base sheet and arranged along a longitudinal direction of the base sheet, and a plurality of marks indicating positions of the plurality of labels, and wherein the optical sensor detects the mark.

13. The image forming apparatus according to claim 1, wherein the recording medium is a cut-form paper, and wherein the optical sensor detects presence or absence of the cut-form paper.

14. The image forming apparatus according to claim 1, further comprising a transfer portion that transfers a developer image onto the recording medium conveyed along the conveyance path, and wherein the sensor cover and the optical sensor are disposed in the vicinity of the transfer portion.

* * * * *